United States Patent [19]

Ohashi

[11] Patent Number: 4,733,035

[45] Date of Patent: Mar. 22, 1988

[54] SWITCH WITH DEVICE FOR PREVENTING ERRONEOUS OPERATION

[75] Inventor: Shigeo Ohashi, Tokyo, Japan

[73] Assignee: Nihon Kaiheiki Industrial Co., Ltd., Tokyo, Japan

[21] Appl. No.: 884,141

[22] Filed: Jul. 10, 1986

[30] Foreign Application Priority Data

Jan. 28, 1986 [JP] Japan ..... 61-9617[U]
Apr. 4, 1986 [JP] Japan ..... 61-49681[U]

[51] Int. Cl.[4] ..... H01H 3/20

[52] U.S. Cl. ..... 200/328; 200/153 J; 200/43.18

[58] Field of Search ..... 200/43.18, 43.16, 153 J, 200/340, 328, 159 R, 153 L, 153 LA, 153 LB, 5 A, 318, 324, 325

[56] References Cited

U.S. PATENT DOCUMENTS 2,119,778 6/1938 Crockett, Jr. ..... 200/328
2,523,125 9/1950 Ley ..... 200/340

FOREIGN PATENT DOCUMENTS 2447003 4/1975 Fed. Rep. of Germany ..... 200/328
41-6523 4/1966 Japan .
1235114 6/1971 United Kingdom ..... 200/328

*Primary Examiner*—Henry J. Recla
*Assistant Examiner*—Linda J. Sholl
*Attorney, Agent, or Firm*—Armstrong, Nikaido, Marmelstein & Kubovcik

[57] ABSTRACT

A switch operating member is provided in an opening at the upper portion of a switch housing, and a rotary knob has a cylindrical portion arranged about the operating member. A restoring spring has one end thereof engaged with the switch housing and has its other end engaged with the rotary knob. Locking means are provided comprising a projection on the outer periphery of the operating member and an engaging portion on the cylindrical portion of the rotary knob, or vice versa. The operating member is automatically locked against up-and-down movement when the projection is brought into locking engagement with the engaging portion owing to restoration of the rotary knob. A cam groove having steps for preventing reverse movement is provided on the operating member as the engaging means. The switch operating member is locked at an initial position while the projection is in abutting contact with the cam groove. When the switch is unlocked by turning the rotary knob, the operating member can be manipulated, after which the operating member is returned to its initial position and locked automatically by restoration of the rotary knob and the operating member. This prevents the user from forgetting to lock the switch and also prevents the switch from being operated erroneously or inadvertently.

1 Claim, 19 Drawing Figures

SWITCH WITH DEVICE FOR PREVENTING ERRONEOUS OPERATION

BACKGROUND OF THE INVENTION

This invention relates to a switch having a locking mechanism and equipped with a device for preventing erroneous operation. More particularly, the invention relates to a switch of the type described in which the lock is released only by turning a rotary knob integrated with an operating portion, and in which inadvertent open-and-down movement of a switch operating member is prevented.

The spread of equipment for office and factory automation has become quite pronounced in recent years. Such equipment is extremely effective but inadvertent or careless operation of switches possessed by the equipment can lead to a major accident. For example, if the power supply switch of a device such as a word processor is inadvertently turned off while the device is in the course of processing important data, which may have taken many long hours and considerable manpower to prepare, the data may be destroyed. There is also the likelihood that erroneous operation of various switches will cause the data to be processed incorrectly.

Problems of the type described will tend to occur with greater frequency as the electronic processing of information becomes more widespread. One approach for dealing with them in the case of a device such as a word processor is to provide the power supply switch at a location where one is constrained to search for it, such as at the side or back of the device. However, disposing the power supply switch in such fashion makes it difficult to use the switch and erroneous operation can still occur if the switch is struck accidentally by some object.

To prevent such accidents from occuring, a power supply or other switch preferably is provided with its own a locking mechanism to prevent erroneous or careless operation.

To this end, and by way of example, the specification of Japanese Utility Model Publication (Kokoku) No. 41-6523 discloses a locking-type push-button switch that requires to be operated in two different directions. Specifically, the switch requires both rotating and pushing operations. Let us describe the structure and operation of this switch in brief with reference to FIGS. 1 through 3.

As shown, the locking-type push-button switch is constituted by a contact unit 5 comprising fixed contacts 1, movable contacts 2, a restoring spring 3 and a shaft 4, a push button 10, a rotary knob 11, a biasing spring 12, an annular leaf spring 13, an attachment fixture 15, and a locking pin 16. The push button 10 is biased downwardly by the spring 12 against the force of the restoring spring 3 in the contact unit 5. The rotary knob 11 has a central bore and includes a lower cylindrical portion 17 the outer surface of which is provided with a circumferentially extending spring receiving groove 14 and a longitudinal groove 18 for mounting the annular leaf spring 13. The lower cylindrical portion 17 has a lower end face in which are formed a V-shaped cam groove 19 and a shallow locking groove 22 contiguous to the V-shaped groove 19, these grooves passing entirely through the cylindrical portion. The attachment member 15 is provided with a central bore the inner surface whereof is provided with a longitudinal groove 20 for positioning and guiding both a projection 21 on the annular leaf spring 13 and the locking pin 16. Though the leaf spring 13 has the projection 21 at opposing positions on its inner and outer side, the spring 13 has an annular configuration overall. The locking pin 16 is for engaging with the V-shaped cam groove 19 and locking groove 22 and is embraced from both sides by the push button 10 and the shaft 4, which is urged upwardly by the restoring spring 3 of contact unit 5.

In operation, finger pressure applied to and removed from the push button 10 causes the locking pin 16 in contact with the push button 10 to be moved up or down while it slides on a vertical surface of the V-shaped cam groove 19, and causes the contacts in the contact unit 5 to changeover. The push button is not locked merely by being pushed. To effect locking, it is also necessary that the rotary knob 11 be rotated in the clockwise direction. When this is done, the locking pin 16, which can travel only up and down along the longitudinal groove 20, moves out of the V-shaped cam groove 19 from its bottom portion and into the locking groove 22 along its inclined surface owing to rotation of the knob 11 and is eventually seated in the locking groove 22. As a result of this series of operations, the locking pin 16 is moved downwardly so as to urge the shaft 4 of the contact unit 5 downwardly against the restoration force of the restoring spring 3. Eventually, the locking pin 16 descends to a position at which balance is achieved between the elastic force of the annular leaf spring 13 and the spring force of the restoring spring 3 in the contact unit 5. The contact unit 5 is changed over when this position is reached. This is the locked state, which is maintained until the rotary knob 11 is turned in the counter-clockwise direction to release the lock.

Thus, in the conventional locking-type push-button switch described above, the direction in which the push button 10 is operated differs from that in which the rotary knob 11 is operated. Though this is effective in terms of preventing erroneous operation, locking is achieved by rotating the knob 11, and this operation is entirely independent of that for working the push button 10. As a result, the switch possesses a complicated structure. In addition, the switch cannot be locked automatically by pressing the push button 10. Locking is accomplished only by rotating the knob 11, which is not operatively associated with the push button 10. Consequently, it is difficult to perform the locking and button depressing operations in concert. In actuality, therefore, preventing erroneous operation of the push button 10 involves some difficulty. Furthermore, one is likely to mistakenly assume that the push-button switch is locked after pressing the push button 10, a lapse that can, in the end, invite erroneous operation of the push button.

Moreover, since the rotary knob 11 is not only for unlocking the switch, the locking function performed by the rotary knob 11 and the circuit changeover function performed by the push button 10 are not clearly distinguished. If the user operates the rotary knob 11 with the intention of locking the switch, the circuit will be switched inadvertently.

SUMMARY OF THE INVENTION

An object of the present invention is to provide a switch having a device for reliably preventing erroneous operation of the switch, wherein the function of a switch operating member and the function of a switch-locking rotary knob are differentiated from each other and only an unlocking action is performed by the rotary knob, yet wherein an operative association is maintained between the switch operating member and the rotary knob.

Another object of the present invention is to provide an inexpensive and compact switch having a device for preventing erroneous operation, the switch affording the user with a "click" sensation when operated.

A further object of the present invention is to provide a switch having a device for preventing erroneous operation, in which the switch is readily unlockable and is adapted to be locked automatically in operative association with a switch operating member to prevent the user from forgetting to lock the switch.

According to the present invention, the foregoing objects are attained by providing a switch having a device for preventing erroneous operation, the switch having a rotary knob provided with a cylindrical portion about the pheriphery of a switch operating member, a switch housing arranged outside the rotary knob, a restoring spring having one end thereof engaging the switch housing and its outer end engaging the rotary knob, and a locking mechanism. The locking mechanism includes a projection on the outer periphery of the operating member and an engaging portion on the cylindrical portion of the rotary knob, or vice versa. Rotating the rotary knob locks the push button against up-and-down movement.

With regard to the locking mechanism, a cam groove is provided as the engaging portion, and the operating member is locked against up-and-down movement by the cam groove. After the push button is unlocked by turning the rotary knob, the projection moves along the cam surface of the cam groove sequentially in one direction, with reverse movement being prevented by steps formed in the groove. With restoration of the rotary knob, the operating member is automatically returned to and locked at its initial position.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 15(*b*) is a perspective view of an engaging piece according to the third embodiment of the invention;

FIG. 15(*c*) is a perspective view of an engaging piece according to a fourth embodiment of the invention;

DESCRIPTION OF THE PREFERRED EMBODIMENTS

Figure 1:
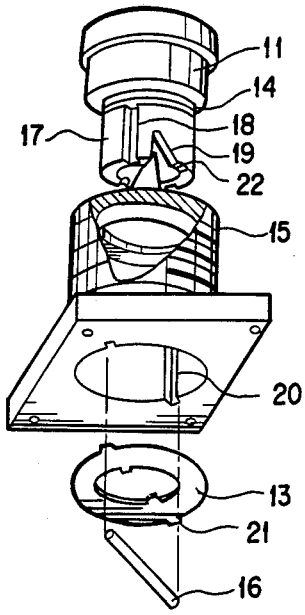
FIG. 1 PRIOR ART
FIG. 1 is an exploded perspective view showing the principal portion of a conventional locking-type push-button switch.
Figure 2:
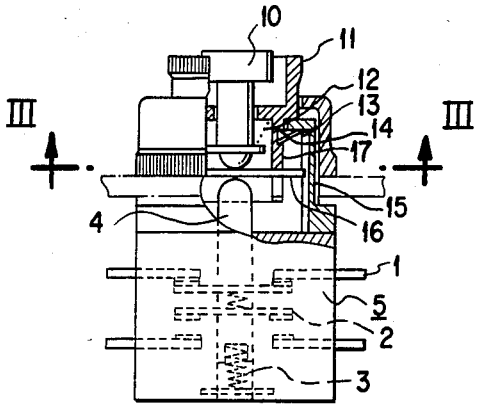
FIG. 2 PRIOR ART
FIG. 2 is a side view, partially cut away, showing the principal portion of the conventional switch of FIG. 1.
Figure 3:
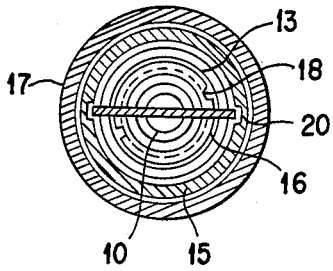
FIG. 3 PRIOR ART
FIG. 3 is a sectional view taken along line III—III of FIG. 2.
Figure 4:
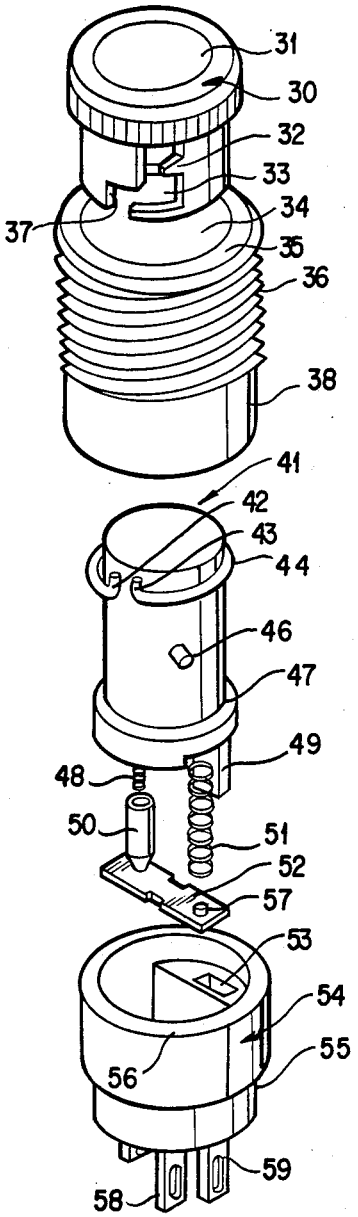
FIG. 4 is a exploded perspective view illustrating a first embodiment of a switch according to the present invention.

Preferred embodiments of the present invention will now be described with reference to the drawings.

With reference FIGS. 4 through 7, a first embodiment of a switch according to the present invention includes a push button 41 as an operating member. The push button 41 is provided with a projection 46 protruding from the outer periphery thereof. The switch also includes a rotary knob 30 provided with a projection 32 formed in a key-shaped cut-out 33 constituting an engaging portion. The projections 32, 46 are so arranged as to engage each other. The push button 41 has a lower portion provided with a flange 47 having a downwardly projecting leg 49 integral therewith. The lower end face of the push button 41 is formed to include a cavity 45 accommodating a plunger 50 equipped with springs 48, 51. A restoring spring 44 of a generally C-shaped configuration is obtained by cutting through an arcuate portion of a wire-like body or by bending the wire-like body, and the end portions of the spring are bent in a required direction to form bent portions 42, 43. A movable contact 52 has a central portion supported by a fixed contact 58. The movable contact 52 is provided at one portion with a projection 57 for engaging one end of the spring 51. The movable contact 52, on which the plunger 50 slides, is arranged to switch a circuit by being rocked back and forth.

A switch body 54 has a guide hole 53 into which the leg 49 of push button 41 is inserted. Secured to the center of the switch body 54 is the fixed contact 58 serving as the fulcrum of the movable contact 52, as well as changeover fixed contacts 59 on either side of the fixed contact 58.

The rotary knob 30 is generally cylindrical in shape and has a central bore 31 into which the push button 41 is inserted. The rotary knob 30 has a side wall cut away so that the key-shaped cut-out 33 communicates with the central bore 31. The projection 32 for engaging with the projection 46 is formed so as to protrude into the key-shaped cut-out 33. A bushing 35 is secured to the upper portion of the switch body and cooperates with the switch body to form a switch housing. The bushing 35 is used to arrange the rotary knob 30, push button 41 and restoring spring 44 with respect to the switch body 54 and its outer side is formed to include a threaded portion 36 for mounting the entire switch on a mounting plate.

Figure 7:
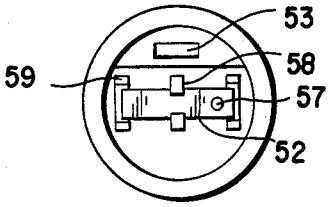
FIG. 7 is a bottom view showing the interior of a switch body in the first embodiment of the invention.

To assemble the switch, first the movable contact 52 is engaged at its narrowed central portion with the fixed contact 58, which serves as the fulcrum, so that the movable contact is rockable freely within the switch body 54. FIG. 7 illustrates this arrangement as seen from above. Next, the leg 49 of the push button 41 is inserted into the guide hole 53 of switch body 54, with the plunger 50 being arranged to oppose the movable contact 52 so as to slide thereon and the spring 51 being engaged at one rend with the projection 57 on the movable contact 52. While the springs 48, 51 are being held so as not to slip out, a first bent portion 42 formed at one end of the restoring spring 44, and a second bent portion 43 formed at the other end of the spring 44 are arranged on the flange 47 so as to arrive at predetermined positions. The bushing 35 is then slipped over the push button 41, the first bent portion 42 of restoring spring 44 is fixed in an anchoring portion 39 of bushing 35, and the restoring spring 44 is movably embraced by a first step portion 40 of bushing 35 and an upper end face 56 of the switch body 54. While this condition is maintained, a lower end of a lower cylindrical portion 38 of the bushing 35 is tightly caulked along a second step portion 55 of the switch body 54. Finally, the rotary knob 30 is inserted into the central bore 34 of bushing 35 while the push button 41 is passed through the central bore 31 of the rotary knob 30. The projection 46 is inserted into the key-shaped cut-out 33 from a opening at its lower end, and the second bent portion 43 of restoring spring 44 is engaged with a spring engaging portion 37, so that a clockwise biasing force acts upon the rotary knob 30.

Figure 5:
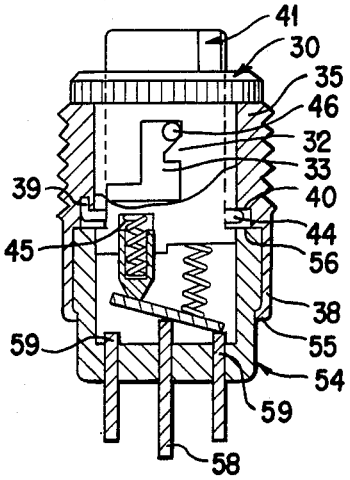
FIG. 5 is a side view, partially cut away, showing the switch of FIG. 4.
Figure 6:
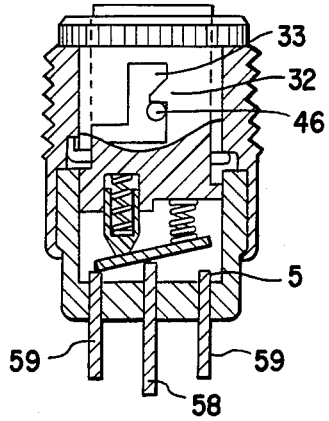
FIG. 6 is a side view, partially cut away, showing the switch of FIG. 4 in the locked state.

When the push button 41 is pressed from the state shown in FIG. 5, the push button 41 is guided vertically by the leg 49 and guide hole 53. The projection 32 provided on the rotary knob 30 is formed to include an oblique surface on its upper side. When the push button 41 is pressed, the projection 46 on the push button 41 moves vertically downward against the oblique surface of projection 32, causing the rotary knob 30 to rotate counter-clockwise against the force of the restoring spring 44. When the projection 46 slides over the tip of projection 32, the rotary knob 30 is rotated in the clockwise direction by the restoring force of restoring spring 44 to be returned to its former position. The push button 41 is locked automatically at this time, as shown in FIG. 6, where it will be seen that the projection 46 on the push button 41 is in abutting contact with the lower side of projection 32. This prevents the push button 41 from returning to its former position. To unlock the push button 41, the rotary knob 30 is rotated counterclockwise from the state shown in FIG. 6 against the restoring force of the restoring spring 44, thereby allowing the projection 46 to ride over the tip of projection 32 so that the push button 41 may be returned to the state shown in FIG. 5 mainly by the restoring force of spring 51.

Figure 8:
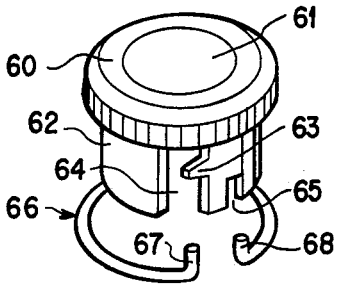
FIG. 8 is a perspective view of a rotary knob according to a modification of the present invention.

A modification of the rotary knob will now be described with reference to FIG. 8. The modification concerns the shape of the spring engaging portion 37 where one end of the restoring spring 44, shown in FIGS. 4 through 7, engages the rotary knob 30. Specifically, the rotary knob, shown at numeral 60 in FIG. 8, has a central bore 61. A cylindrical portion 62 of rotary knob 60 is provided with a spring engaging recess 65 at a position different from that of a key-shaped cut-out 64 formed to include a projection 63. A second bent portion 67 of a restoring spring 66 engages with the spring engaging recess 65. A first bent portion 68 of the restoring spring 66 is anchored to the bushing, as described above.

Figure 9:
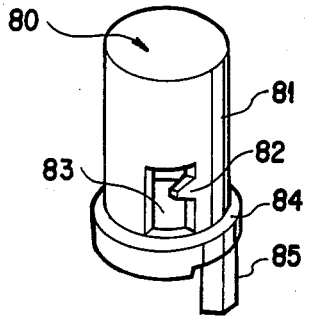
FIG. 9 is a perspective view showing a push button of a switch according to the second embodiment of the invention.
Figure 10:
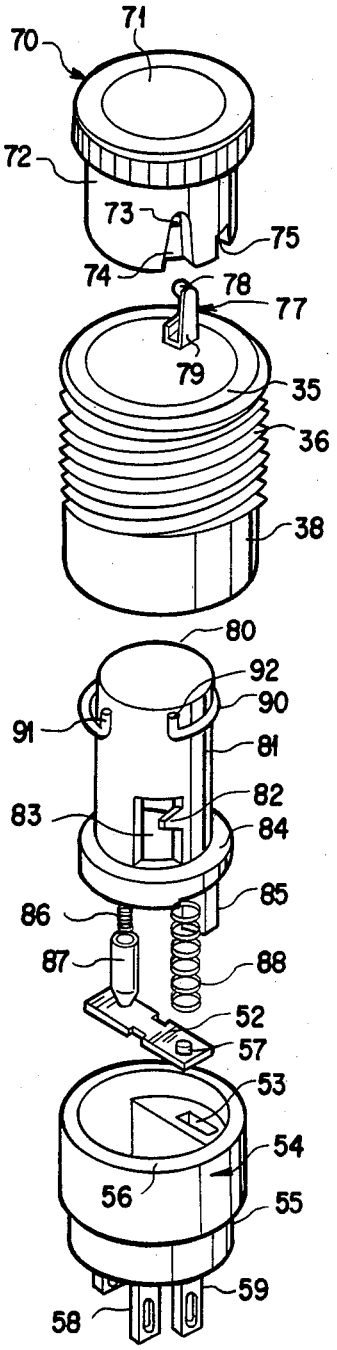
FIG. 10 is an exploded perspective view illustrating a second embodiment of a switch according to the present invention.

Let us now refer to FIGS. 9 and 10 to describe a second embodiment of a switch according to the present invention.

In this embodiment, the structure of the switch locking mechanism differs from that of the first embodiment. Specifically, the push button, shown at numeral 80, has a cylindrical portion 81 formed to include a key-shaped cut-out 83 having a projection 82. The rotary knob, shown at numeral 70, has a central bore 71 and a cylindrical portion 72 the lower end whereof is formed to include a recess 74 and a cut-out 75. The cylindrical portion 72 is penetrated by a through-hole 73 formed at the upper end portion of the recess 74. An engaging piece 77 has a projection 78 projecting inwardly therefrom, and an attaching portion 79. The projection 78 is fitted into the through-hole 73, and the engaging piece 77 is secured in the lower end of the recess 74 of cylindrical portion 72 by the attaching portion 79. Further, a generally C-shaped restoring spring 90 has a first bent portion 91 secured to the bushing 35, and a second bent portion 92 engaging with the cut-out 75 of the rotary knob 70. Numeral 84 denotes a flange, 85 a leg, 86 a spring, and 87 a plunger. These elements are similar to those shown in the first embodiment.

A third embodiment of a switch according to the present invention will now be described with reference to FIGS. 11 through 14.

A rotary knob 111 has a central bore 114 through which a push button 133 is passed, and a cylindrical portion 113 provided with a recess 116 having a through-hole 115, a cut-out 119 at the lower end of the cylindrical portion for engaging a bent portion 131 of a restoring spring 130, and finger 117 at the lower end of the cylindrical portion having a projection 118 for resiliently engaging an inner step portion 128*a* of a bushing 123 to prevent the rotary knob 111 from falling out. An engaging piece 120 comprises a resilient body one end of which is bent to form a projection 121 the distal end whereof penetrates a through-hole 115 to come into abutting contact with a cam groove 135, which is formed in the side of a cylindrical portion 134 of the push button 133. The other end of the engaging piece 120 is formed to include an attaching portion 22, which has a generally U-shaped cross section for embracing the lower end portion of the recess 116.

Figures 15A, 15B, 15C:
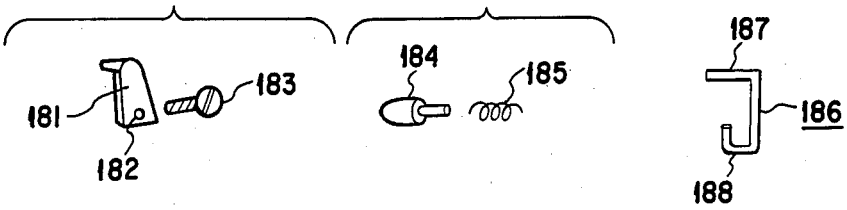
FIG. 15(*a*) is a perspective view of an engaging piece according to the second embodiment of the invention.

The construction of the engaging piece 120 is not limited to that described above. For example, in FIG. 15(*a*), the attaching portion 122 of the engaging piece 120 described above is replaced by an arrangement in which a hole 182 is provided in an engaging piece 181 and a screw 183 is inserted into the hole 182 to secure the engaging piece 181 to the recess 116. In FIG. 15(*b*), the engaging piece 120 is replaced by a pin 184 and a coil spring 185. In FIG. 15(*c*), the engaging piece 120 is replaced by a single rod-shaped resilient body 186 formed to include a projection 187 and an attaching portion 188.

Returning to FIGS. 11 through 14, the bushing 123 has a central bore 124 and an upper cylindrical portion having attaching threads 125 on its outer side. The lower portion of the bushing 123 is formed to include a skirt portion 126 having an outer step 128 and a chaulking portion 127 for fixing a switch body 145 on the inner side of the skirt portion 126. Formed in the bushing 123 at the lower end of the bore 124 is a recess 129 for receiving an engaging portion 132 of a restoring spring 130. The recess 129 need not necessarily be formed at the lower end of the central bore 124 but can be provided at any suitable location depending upon the shape of the restoring spring 130.

Figure 14:
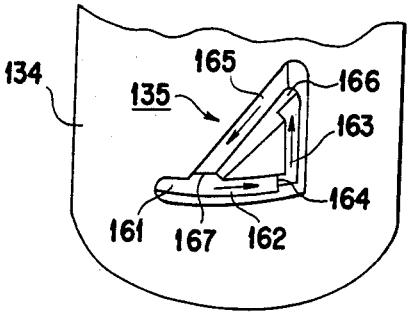
FIG. 14 is an enlarged perspective view of a locking cam groove according to the third embodiment of the invention.

The push button 133 comprises a cylindrical portion 134 having the cam groove 135 formed in its side, a flange portion 136 formed on the lower end of the cylindrical portion 134 and defining a step 137, a leg 138 formed on the lower end face of the flange portion 136 for preventing rotation of the push button 133, and a plunger 139 for driving a commutator 140. Disposed on the step 137 so as to encircle the cylindrical portion 134 is the restoring spring 130, which has a generally C-shaped cross section. As shown in FIG. 14, the cam groove 135 includes an insertion portion 161, which is located at a stationary locking position; a horizontal groove 162 extending from the insertion portion 161, the groove 162 having a bottom surface formed to rise gradually at an incline; a vertical groove 163 communicating with the horizontal groove 162, the bottom surface of the groove 163 being deeper than that of the groove 162 to form a step 164 where the two grooves meet, the bottom surface of groove 163 also being formed to rise gradually at an incline; and an oblique groove 165 communicating with the vertical groove 163 at one end at the horizontal groove 162 at the other end. The bottom surface of the groove 165 is deeper than that of the groove 163 to form a step 166 where the two grooves meet, and is formed to rise gradually at an incline. The bottom surface of the horizontal groove 162 is deeper than that of the groove 165 to form a step 167 where the two grooves meet. Thus, the projection 121 of the engaging piece 120 moves along a path defined by the insertion portion 161, horizontal groove 162, vertical groove 163, oblique groove 165 and insertion portion 161 in the order mentioned. The cam groove 135 thus has a generally triangular configuration overall.

The commutator 140 comprises a generally C-shaped guide wall 141 provided at its central portion with a guide groove 142 having an inclined floor, a slide rod 143 projecting from the lower end of the guide wall 141, and a coil spring 144 for urging the guide wall 141 in its longitudinal direction. The commutator 140 is accommodated in a recess in a guide wall 150 of the switch body 145.

The switch body 145 comprises an upper portion 146 provided with a central bore, a lower portion 147 provided with a recess and joining the upper portion 146 at a step 148, a terminal 152 implanted the floor of the lower portion 147 and having a fixed contact 166, and a movable terminal 165 supported on a common contact 167. An inward extension 151 of the upper portion 146 defining the guide wall 150 is formed to include a guide hole 149. The commutator 140 is arranged in the recess, one side of which is the guide wall 150, so as to be freely movable. The leg 138 of push button 133 is guidably inserted in the guide hole 149. The plunger 139 of push button 133 is in sliding contact with the guide groove 142.

Figure 12:
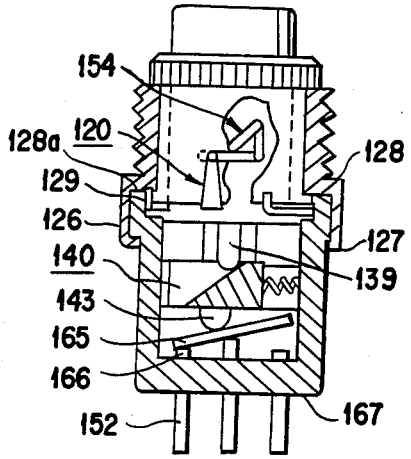
FIG. 12 is a side view, partially cut away, showing the switch of FIG. 11.
Figure 13:
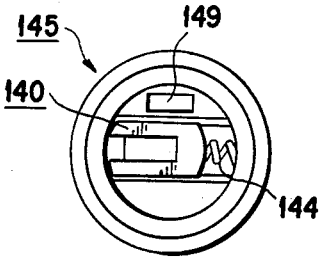
FIG. 13 is a top view of a switch body according to the third embodiment of the invention.

In the steady state, as shown in FIG. 12, the projection 121 of engaging piece 120 lies in the insertion portion 161 at all times and the push button 133 is held in a locked state so that it cannot be operated. To unlock the switch, the rotary knob 111 is rotated in the counterclockwise direction against the restoring force of the restoring spring 130, whose engaging portion 132 is engaged by the recess 129 of bushing 123 and whose bent portion 131 is engaged by the cut-out 119 of bushing 123. This causes the projection 121 of engaging piece 120 to drop from the insertion portion 161 of cam groove 135 into the vertical groove 163 via the horizontal groove 162. When this state is attained, the projection 121 is held in check by the step 164 even though it attempts to return under the restoring force of the restoring spring 130. The projection 121 is held in the vertical groove 163 even if the force applied to the knob 111 by the user to rotate the knob is removed. Consequently, the user may remove his finger from the rotary knob 111 and then operate the push button 133. In other words, the user can devote himself solely to operating the push button 133 independently of the locking operation. Next, when the push button 133 is pressed, the push button descends while being guided by the leg 138 and guide hole 149. At the same time, the commutator 140 (FIG. 12) is moved rightward by the plunger 139 via the inclined surface of the guide groove 142 against the force of the coil spring 144. Owing to motion of the commutator 140, the movable contact 165 is rocked and changed over by the slide rod 143. At this time the projection 121 rises in the vertical groove 163 and falls into the oblique groove 165. If the force applied to the push button 133 is removed in this state, the push button 133 rises due to the restoration force of the restoring spring 130 and coil spring 144. The projection 121 therefore moves in the oblique groove 165 and automatically stops upon being received by the insertion portion 161. Thus, the switch is returned to the initially locked position automatically.

An embodiment of a corrugated-type switch will now be described with reference to FIGS. 16 and 17.

Figure 11:
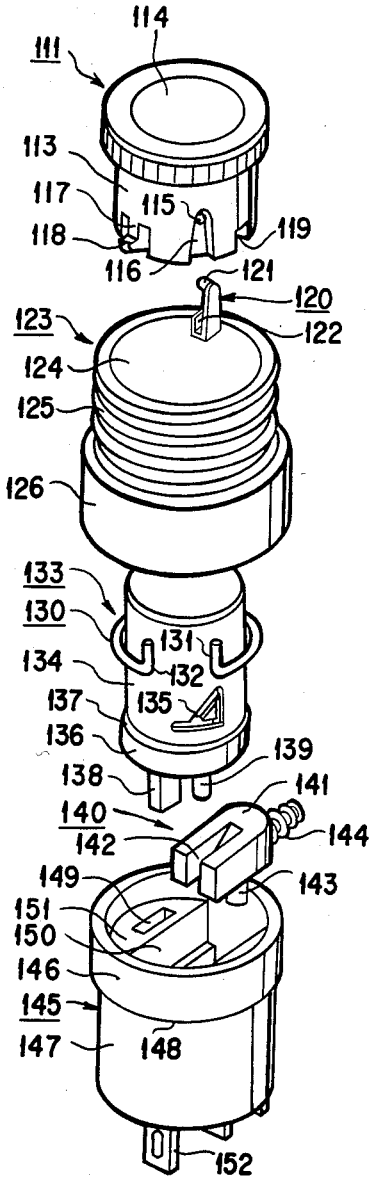
FIG. 11 is an exploded perspective view illustrating a third embodiment of a switch according to the present invention.

A rocker-type button 170 is pivotally supported on a stationary portion by a shaft 172 and is operated by being rocked back and forth about the shaft 172. A cam groove 171 of the type shown in FIG. 14 is formed in the side face of the button 170 at a point lying substantially at right angles to the shaft 172. Though not shown, a projection on an engaging piece of the type shown in FIGS. 11, 12 and 15 is engaged with the cam groove 171 to form a locking mechanism similar to that described in the earlier embodiments. The switch also includes a rotary knob 173, a switch mounting nut 174, a switch body 175, and a terminal 176.

Figure 16:
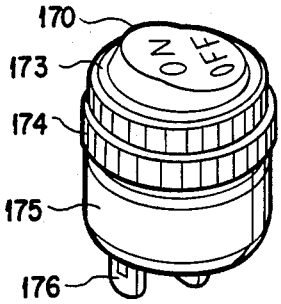
FIG. 16 is a perspective view showing the external appearance of a switch according to a fourth embodiment of the invention.
Figure 17:
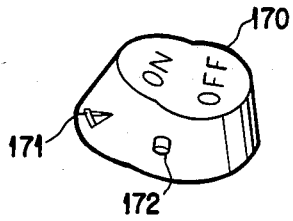
FIG. 17 is an enlarged perspective view showing an operating member in the switch of FIG. 16.

In the embodiment of FIGS. 16 and 17, a rocker-type lever (not shown) can be used as the switch operating member, as well as the above-described push button or rocker-type corrugated button.

The present invention described above hereinabove has the following advantages:

(1) The rotary knob effects an unlocking operation only and the switch operating member is locked automatically after being operated. Accordingly, the switch is readily unlocked and switch operability is improved. Moreover, unlike the case with conventional switch having a locking device, one cannot forget to lock the switch of the present invention, thus assuring reliable locking at all times.

(2) The rotary knob and the switch operating member are disposed within the opening of the switch housing, and the locking mechanism is incorporated within the switch proper in integrated fashion, thus enabling the switch to be constructed in compact form. Moreover, since the rotary knob is disposed closely about the periphery of the switch operating member, idle space is reduced and switch appearance improved.

(3) Since the locking member is not visible from outside the switch, the switch can be locked secretly, and thus acts as a simple key switch, to cope with tampering by outsiders or children.

(4) The switch of the present invention can be simply constructed by providing a conventional miniature switch, particularly the popular miniature push-button switch, with simple additional parts and some additional machining.

(5) In the switch of the third embodiment, the locking mechanism is so arranged that a projection engages with and moves successively along a generally triangular cam groove having step portions for checking the motion of the projection. This assures reliable and stable operation.

As many apparently widely different embodiments of the present invention can be made without departing from the spirit and scope thereof, it is to be understood that the invention is not limited to the specific embodiments thereof except as defined in the appended claims.

What we claim is:

1. A switch including means for preventing erroneous operation, comprising:

a switch body having fixed contacts and a movable contact mounted therein;

a bushing securing to an upper portion of said switch body, said bushing having a generally cylindrical body with a central bore therethrough;

a generally cylindrical rotary knob having a cylindrical lower portion rotatably fitting said bushing central bore and having a large upper knob portion abutting on an upper surface of said bushing, said rotary knob having a central bore therethrough;

a cylindrical push button axially movable in said rotary knob central bore and having at a lower face thereof a leg fitting to a guide hole in said switch body and a plunger operatively engageable with said movable contact to actuate said contact;

said cylindrical outer surface of said push button and said cylindrical lower portion of said rotary knob being provided with cooperating camming elements having abutting surfaces; and a restoring spring arranged between said rotary knob and said bushing to apply rotational biasing force to said rotary knob;

said camming elements being formed such that said rotational biasing force urges said rotary knob to a normally locked position wherein said push button is blocked against axial movement that would actuate said switch contacts, wherein manual rotation of said rotary knob against said biasing force operates to unblock said camming elements so that said push button may be operated axially to actuate said switch movable contact, and said axial operation and subsequent release and reverse axial movement of said push button causes said cooperating camming elements to operate to allow said rotational biasing force to return said rotary knob to said locked position and restore a blocked condition of said push button wherein said camming elements comprise a triangular shaped cam groove formed in the cylindrical surface of said push button and an engaging piece including a projection resiliently fixed to said rotary knob for engaging said triangular shaped cam groove wherein said triangular shaped cam groove includes a first groove portion extending peripherally around said cylindrical push button surface, a second groove portion extending axially on said push button surface, and a third oblique groove portion connecting said first and second sections, said groove sections each being formed with an inclined bottom surface that rises gradually to a point where the groove section meets the next groove section at a portion thereof where said bottom surface has a greater depth whereby said engaging piece is initially positioned in said first groove portion until said rotary knob is rotated to said second groove portion thus latching said engaging piece into said second groove portion and allowing axial movement of said push button, the axial movement of said push button allows said engaging piece to align with said third oblique groove to allow said cylindrical push button to return to its initial position.

* * * * *